US011021322B1

(12) United States Patent
Oscar

(10) Patent No.: US 11,021,322 B1
(45) Date of Patent: Jun. 1, 2021

(54) RESEALABLE DISPOSABLE BAG WITH AIR RELEASE FLAP

(71) Applicant: Oliver Oscar, Colton, CA (US)

(72) Inventor: Oliver Oscar, Colton, CA (US)

( * ) Notice: Subject to any disclaimer, the term of this patent is extended or adjusted under 35 U.S.C. 154(b) by 0 days.

(21) Appl. No.: 15/929,717

(22) Filed: May 18, 2020

(51) Int. Cl.
*B65F 1/00* (2006.01)

(52) U.S. Cl.
CPC ..... *B65F 1/0026* (2013.01); *B65F 2210/129* (2013.01); *B65F 2210/167* (2013.01); *B65F 2220/116* (2013.01); *B65F 2250/108* (2013.01); *B65F 2250/11* (2013.01); *B65F 2250/1146* (2013.01)

(58) Field of Classification Search
CPC ..... B65F 2210/129; B65F 2210/167; B65F 2220/116; B65F 2250/108; B65F 2250/11; B65F 2250/1146
USPC ..... 383/3
See application file for complete search history.

(56) References Cited

U.S. PATENT DOCUMENTS 4,746,060 A * 5/1988 Morehouse ..... B65D 33/01 229/101
4,904,489 A * 2/1990 Bach ..... B65D 81/34 383/100
5,881,881 A * 3/1999 Carrington ..... B65D 77/225 206/524.8
2006/0127549 A1* 6/2006 Murray ..... B65D 75/5827 426/393
2018/0043046 A1* 2/2018 Devine ..... A23L 3/00

* cited by examiner

*Primary Examiner* — Jes F Pascua
(74) *Attorney, Agent, or Firm* — David Michie

(57) ABSTRACT

A discrete food waste disposal bag is a hand held waste receptacle that will hold and conceal waste. A disposable bag comprising: a body having an open end portion and a sealed end portion, an air release flap located on the body between the open end portion and the sealed end portion, wherein the air release flap allows air to exit the body of the disposable bag, a first opening located at the end of the open end portion, wherein a user blows air into the first opening, a tear line located on the body approximate to the open end portion, wherein the tear line is configured to expose a second opening, wherein the first opening is smaller than the second opening.

20 Claims, 8 Drawing Sheets

FIG. 8A
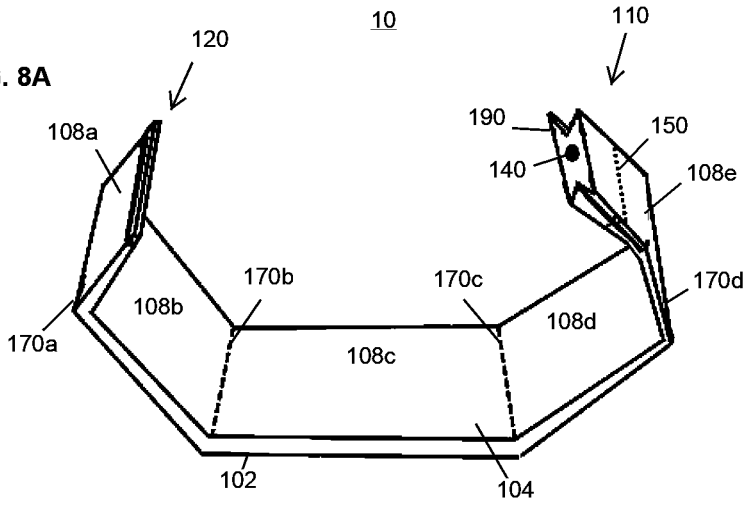
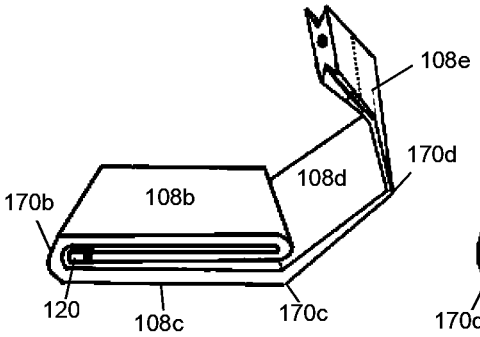
FIG. 8B
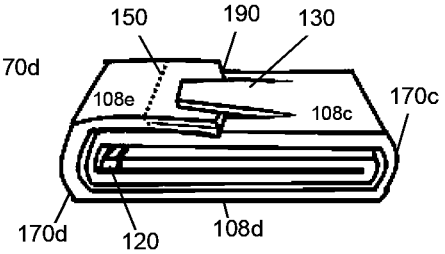
FIG. 8C

RESEALABLE DISPOSABLE BAG WITH AIR RELEASE FLAP

CROSS-REFERENCE TO RELATED APPLICATIONS

Not Applicable

FEDERALLY SPONSORED REASEARCH

Not Applicable

FIELD OF INVENTION

This invention relates to disposable bags, more particularly, to resealable disposable bags for food waste with an air release flap.

BACKGROUND

Most foods have indigestible parts or waste that will need a place to be discarded. Often times, food waste is place or expelled via spitting on the ground. Other times, paper napkins, cups, or plates are used to hold food waste but these items serve other purposes and are not a suitable discarding receptacle.

To maintain a clean and hygienic environment, there is a need for a discrete food waste disposal bag that can be used store food waste until a proper waste receptacle is located.

BRIEF SUMMARY OF THE INVENTION

A discrete food waste disposal bag is a hand held waste receptacle that will hold and conceal waste. A disposable bag comprising: a body having an open end portion and a sealed end portion, an air release flap located on the body between the open end portion and the sealed end portion, wherein the air release flap allows air to exit the body of the disposable bag, a first opening located at the end of the open end portion, wherein a user blows air into the first opening, a tear line located on the body approximate to the open end portion, wherein the tear line is configured to expose a second opening, wherein the first opening is smaller than the second opening. Further comprising: a first seal, wherein the first seal is located in the first opening; a second seal, wherein the first seal is located in the second opening; and a third seal, wherein the third seal is located in a third opening of the air release flap.

BRIEF DESCRIPTION OF THE DRAWINGS

FIGS. 8A-8C illustrate the method steps by which a user can fold the disposable bag of the present invention.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art.

Figure 1:
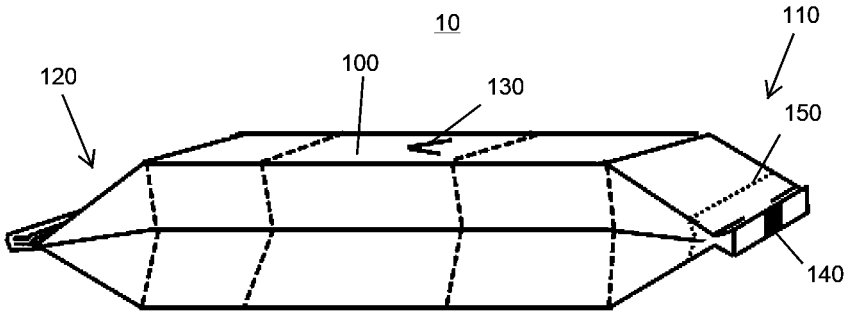
FIG. 1 is a perspective view showing an inflated disposal bag of the present invention.

Referring to FIG. 1, an example of a disposable bag 10 embodying this invention is shown as having a body 100 that may be inflated. The body 100 has an open end portion 110, a sealed end portion 120, an upper surface 102, and a lower surface 104. The open end 110 and the sealed end 120 may be regions of the body 100. The sealed end portion 120 may be permanently sealed by adhesive, thermal, mechanical stamping, or other conventional means used to seal disposable bags. The body 100 also includes an air release flap 130. The body 100 also has a cavity 106 where food waste or waste is stored. The body 100 may have a substantially rectangular shape as shown in FIG. 1, the body 100 may any shape such as a round shape, a spherical shape, a cylindrical shape, a square shape, a conical shape, etc. In some embodiments, the cavity 106 may also store fluids.

The open end portion 110 and the sealed end portion 120 are shown as having a straight edge in FIG. 1. The open end portion 110 and the seal end portion may have any shaped edge such as a round edge, a semi-circle edge, a semi-oval edge, a zig-zag edge, including one or more zig-zags, a slanted edge, where one corner extends pass the other corner, a wavy edge, etc.

The disposable bag 10 may be made from a flexible material including but not limited to paper, plastic, leather, vinyl, organic fabric, polypropylene, metal, composite metal, or in combination. The preferred embodiment of the disposable bag 10 may be constructed from aluminum foil, paper, plastic or the combination thereof. The material used for the body 100 should be stiff to maintain structure, but flexible so that the body can be expanded, compressed, and/or folded. The disposable bag 10 may be made of a printable material, where a graphical design may be placed or printed on the body 100. The graphical design may include pictures, words, colors, text, lines, shapes, etc. The graphical design may include thermal color ink that may change colors when subjected to different temperatures.

In some embodiments, the cavity 106 of the body 100 may be coated with a sealing material, the sealing material includes wax, plastic, polypropylene, rubber, or other water impermeable material. In some embodiments, the cavity 106, the open end 110, and the sealed end 120 may be coated with an anti-bacterial material. In some embodiments the sealing material may be scented with a fragrance to compete with any odor from the waste disposed within the cavity 106. In some embodiments, the fragrance may be stored in the air release flap 130 and may be activated upon release of air.

Figure 2A:
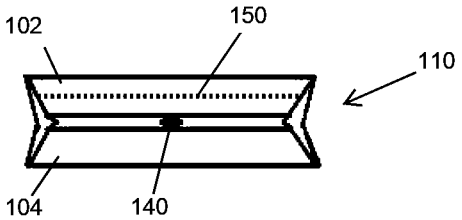
FIG. 2A is a side view of a first opening of the open end portion.

The open end portion 110 may contain a first opening 140, as best shown in FIG. 2A. The first opening 140 may be used by the user to blow air into the body 100. The first opening 140 may be smaller than an edge of the open end portion 110. In some embodiments, a portion of the edge of the open end portion 110 may be permanently sealed 200, as best shown in FIG. 2C. The sealed portion of the edge of the open end 110 may be sealed similar to the sealed end 120, as mention above. In one embodiment, the first opening 140 may be a perforated shaped outline or a machine pressed line 146 that requires the user to puncture before the first opening 140 may be used.

Figure 2B:
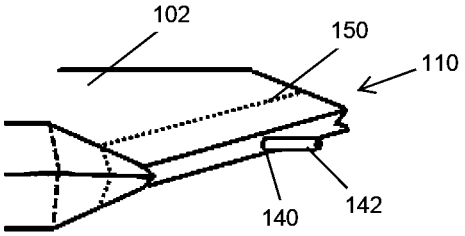
FIG. 2B is a perspective view of one embodiment of a first opening of the open end portion of the present invention.
Figure 2C:
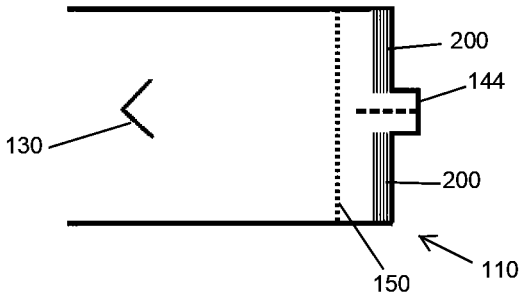
FIG. 2C is a top view of one embodiment of a first opening of the open end portion of the present invention.

In another embodiment, the first opening 140 may be used in conjunction with a tube or straw 142 as seen in FIG. 2B. The tube or straw 142 may be made from plastic, paper, organic material, or flexible metal, such as aluminum foil. The user may insert the stray 142 into the first opening 140 or use the straw 142 to puncture the perforation shaped outline or the machine pressed line 146 of the first opening 140. Next, the user may blow air into the cavity 106 to inflate and expand the body 100.

Figure 3A:
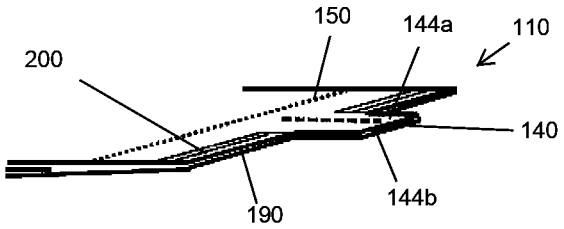
FIG. 3A includes a perspective view of one embodiment of the first opening in a flat state and FIG. 3B is a side view of the first opening in a round state of said embodiment.
Figure 3B:
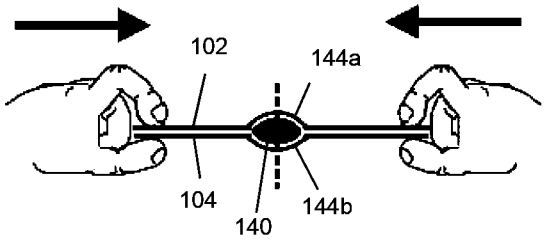

In another embodiment, the first opening 140 may be a protrusion 144 from the open end portion 110, as seen in FIG. 3A. The protrusion 144 acts as a mouth piece where the user may push the two end corners of the open end portion 120 together as seen in FIG. 3B. The protrusion 144 goes from a flat state, where upper and lower surfaces 144*a*, 144*b* of the protrusion 144 at the open end portion 110 are parallel, to a round state, where the upper and lower surfaces 144*a*, 144*b* of the protrusion 144 form a cylinder opening into the body 110 as shown in FIG. 3B. The upper and lower surfaces 144*a*, 144*b* may be an extension of the upper and lower surfaces 102, 104 of the body 110.

Figure 4A:
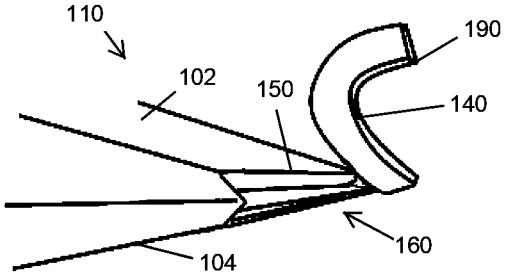
FIG. 4A is a perspective view of the second opening with partial removal of an edge of the open end portion of the presentation invention shown in FIG. 1
Figure 4B:
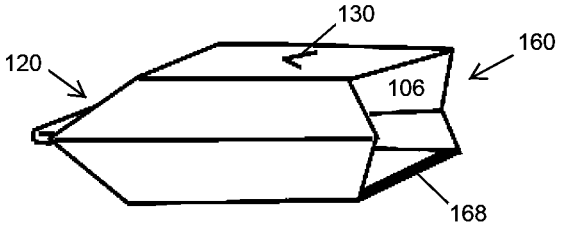
FIG. 4B is a perspective view of the second opening with a complete removal of the edge of the open end portion.
Figure 4C:
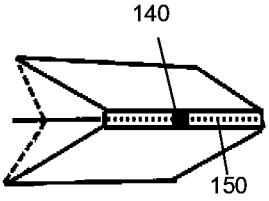
FIGS. 4C to 4E show various embodiments of tear lines of the present invention.
Figure 4D:
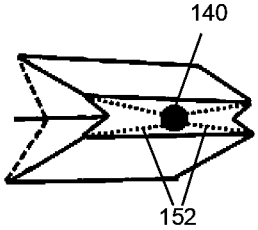
Figure 4E:
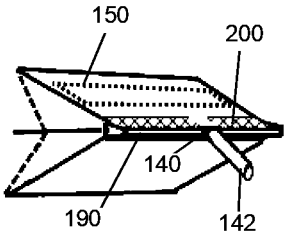

Now referring back to FIG. 1, the open end portion 110 may contain a tear line 150. The tear line 150 may be a perforated line or a machine pressed line across the body 100 within the end portion 110. The tear line 150 may be used to separate an edge 190 of the open end portion 110 from the body 100 as seen in FIG. 4A. In one embodiment, the tear line 150 may be made up of a plurality of lines 152, as best seen in FIGS. 4C to 4E. The user may tear the tear line 150 to create a second opening 160, as best seen in FIG. 4B. The second opening 160 may be use as an opening for discarded waste or food waste.

In another embodiment, the tear line 150 may be on single surface surface 102, 104 of the body 100 as seen in FIG. 4E. The upper surface 102 or the lower surface 104 may be perforated or machine pressed so that the tear line 150 creates the second opening 160 on the the upper surface 102 or the lower surface 104. This embodiment would prevent the accidental loss of the open end portion 110 that may be removed from the body 100, thereby preventing the user from unintentional littering. The tear line 150 may be made by laser, mechanical punch, mechanical press, or mechanical roller means.

In some embodiments, the second opening 160 can be smaller than the cross-sectional volume of the body 100. In some embodiments, the second opening 160 may be larger than the first opening 140.

Figure 5A:
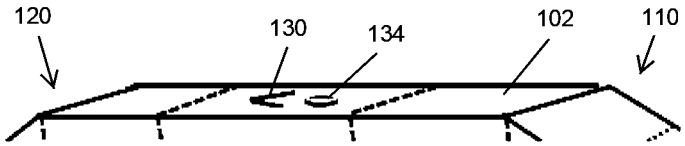
FIG. 5A is a partial view of one embodiment of an air release flap mechanism of the present invention.

Referring to FIG. 5A, the air release flap 130 may be positioned near the center of the body 100. In some embodiments, the body 100 may have one or more air release flaps 130 on the upper surface 102, the lower surface 104. The body 100 may have one or more air release flaps on both the upper surface 102 and the lower surface 104. The user may use the one or more air release flaps 130 to release air from the cavity 106 of the body 100.

Figure 5B:
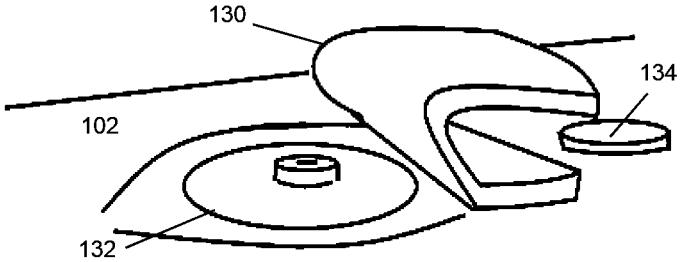
FIG. 5B is a partial view of one embodiment of an one-way valve within the air release flap of the present invention.

In some embodiments, the air release flap 130 contains a one-way valve 132 as seen in FIG. 5B. The one-way valve 132 may allow air to exit while preventing odor from exiting from the air release flap 130. This may be done using an air filter made from paper, organic and non organic fiber, plastic, or carbon charcoal material. In one embodiment, the air release flap 130 may contain a fragrance compartment 139, best seen in FIG. 7B, that releases a fragrance material. The fragrance compartment 139 may be within the air release flap 130, next to the air release flap 130, or within the one-way valve 132. This may be done by unsealing a portion of the air release flap 130, pressing on the fragrance compartment 139 to push the fragrance material through a tube connecting to and out of the air release flap 130, or through the one-way valve 132, where the air exiting the one-way release valve 132 pressurizes and expels the air from the fragrance compartment 139

Figure 6A:
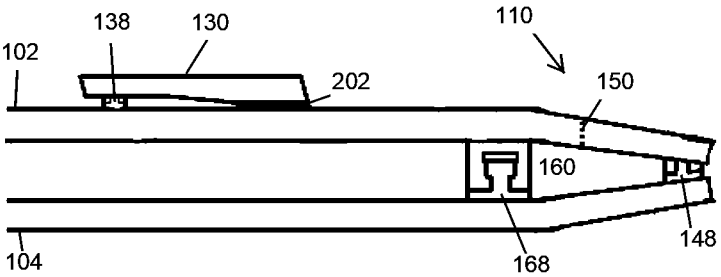
FIGS. 6A and 6B are front sectional views illustrating various embodiments of a first seal, a second seal, and a third seal; and, FIG. 6C is a top partial view of FIG. 6B.
Figure 6B:
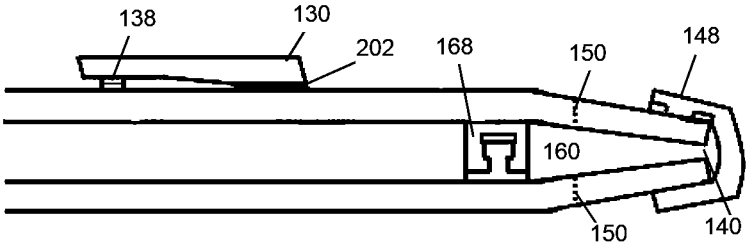
Figure 6C:
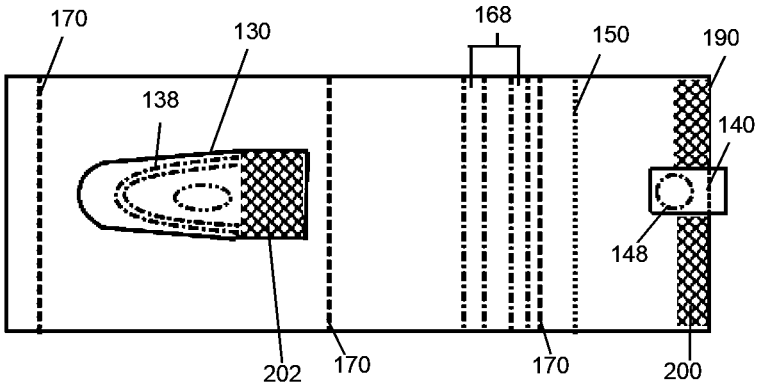

In some embodiments, the air release flap 130 may be an additional material layer permanently sealed on one side to the body 100 to cover a hole or the one-way valve 132 positioned in the body 100 of the disposable bag 10, as shown in FIG. 6C. The air release flap 130 may be permanently sealed at one end of the additional layer by adhesive, thermal, mechanical stamping, or other conventional means used to seal disposable bags. For example, the air release flap 130 may be attached to the upper surface 102 of the body 100 by an adhesive 202, as seen in FIGS. 6A-6C. The air release flap 130 may be made from the same material of the body 100 of the disposable bag 10 or may be made of a different material that is more flexible than the material used for the body 100. For example, the body 100 may be made of paper material, while the air release flap 130 may be made of plastic material. In some embodiments, the air release flap is integral with the body 100 and is made by perforating, cutting, stamping, or lasering the upper or lower surfaces of the body 100.

Figure 5C:
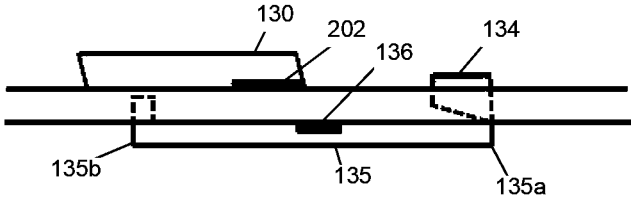
FIGS. 5C and 5D are front sectional views illustrating one embodiment of the air release flap mechanism of the present invention.
Figure 5D:
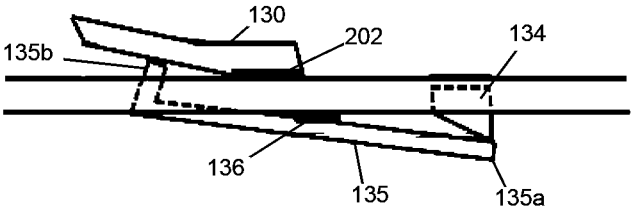

In one embodiment, the user may cover the air release flap 130 or the one-way valve 132 with their finger to prevent air loss from the body 100. In another embodiment, the user may press a button 134 near the air release flap 130 to release the air from the body 100 as seen in FIG. 5C. The button 134 may cause the air release flap 130 to lift from the upper surface 102 of the body 100, as best seen in FIG. 5D. In some embodiments, the button 134 may also release the fragrance material from the fragrance compartment 139. The air release flap 130 may be lifted by a lever 135 that is attached to the cavity 106 of the body 100 at a point 136. The pressure from the user's finger on one end 135*a* of the lever 135 causes the other end 135*b* of the lever 135 to lift the air flap release 130 due to cantilever forces.

Now referring to FIG. 6A, in some embodiments, the first opening 140 may contain a seal 148 that prevents or reduces a fluid from passing through the first opening 140. In another embodiment, the second opening 140 may contain a seal 168 that prevents or reduce a fluid from passing through the second opening 160. In another embodiment, the air release flap 130 may contain a seal 138 that prevents or reduces a fluid from passing through the air release flap 130. The fluid may be in a gas or a liquid state. The seal 138, 148, 168 may be an adhesive, a snap fit, a button, a resealable membrane, an interlocking groove and ridge resealable fastener, i.e., a Ziploc™ seal, a fold in tab, a folding wire, a hook and loop fastener, i.e., a Velcro™ brand strip, or in combination. The seals may be approximate to the respective openings, i.e., inside or outside the openings. FIG. 6 illustrates seals 138, 148, 168 within the body 100. Note, FIGS. 6A to 6C may not be drawn to scale, but is merely and exemplary illustration. The seals 138, 148, 168 may be the same type of seal as described above and shown in FIG. 6A, all different types of seals, or a combination thereof as seen in FIG. 6B. In some embodiments, only one of the seals 148, 168 may be similar to the seal 138. For example, the first seal 148 on the outside of the first opening 140 and the third seal 138 inside the air release flap may contain a resealable adhesive, whereas the second seal 168 within the second opening 160 contains an interlocking groove and ridge resealable fastener. In some embodiments, the first seal 148 and the third seal 138 may be sealed together via their respective resealable adhesives. Connecting the first seal 148 and the third seal 138 may allow the user to fold the body 100 into a semi-permanent position until the user decides to unseal the first seal 148 and the second seal 138.

In some alternate embodiments, the disposable bag 10 may come pre-filled with a product, where the product may be a solid material, a liquid material, or a gas material, or a combination thereof. The seals 138, 148, 168 would prevent a loss of the product and the disposable bag 10 may be resealed with the seals 138, 148, 168 during the life time use of the disposable bag 10, which may depend on the product. For example, the user may receive the disposable bag 10 with the cavity 106 of the body 100 pre-filled with a malt shake. In this example, the user can open the first opening 140 with the straw 142 by puncturing the machine pressed line 146 or opening the seal 148 so that the user can insert the straw 142 to drink the malt shake. The user may then tear the disposable bag 10 along the tear line 150 to reveal the second opening 160 so that the user may spoon out more of the solid or frozen product with a spoon. The user may reseal the first opening 140 and the second opening 160 via the seals 148, 168 while the user moves around with the malt shake. After the user is finished with the malt shake, the user may seal the second opening 160 with the second seal 168 and may release air from the cavity 106 by squeezing the body 100 of the disposable bag 10 after the third seal 138 within the air release flap 130 is opened. The air from the cavity 106 may exit through the one-way valve 132 in the air release flap 130 to deflate the body 100 and may also cause the fragrance material exit along with the air. The user may reseal the air release flap 130 via the third seal 138 to prevent the disposable bag 10 from leaking discarded product. This would reduce the waste volume of the disposable bag 10 and prevent unnecessary odors.

Figure 7A:
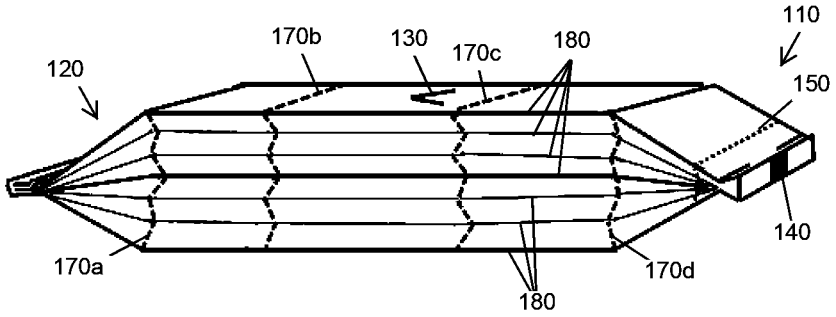
FIG. 7A is a perspective view of one embodiment of the present invention illustrating fold lines.

Now referring to FIG. 7A, the disposable bag 10 may have horizontal fold lines 170 that are substantially parallel to the edge 190 of the open end portion 110 and the sealed end portion 120. The horizontal fold lines 170 may be made up of one or more individual horizontal fold lines. There may be one, two, three, four, five, six, seven, eight, or nine individual horizontal fold lines that make up the horizontal fold lines 170. The horizontal fold lines 170 may be spaced at substantially equally distance from one another. In a preferred embodiment, the horizontal fold lines 170 may be spaced a part from one another by two inches from the sealed end portion 120. The individual horizontal fold lines 170 may make a body segment portion 108 of equal size. In some embodiments, the body segment portion 108 closest to the open end portion 110 is smaller than the other body segment portions 108.

Figure 7B:
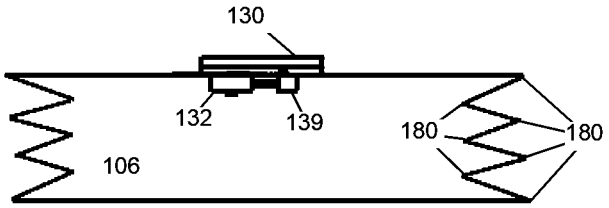
FIG. 7B is a side sectional view of FIG. 7A that includes the one-way air valve and a fragrance compartment of the one embodiment.

The disposable bag 10 may also have vertical fold lines 180 that are perpendicular to the edge 190 of the open end portion 110 and the sealed end portion 120. The vertical fold lines 180 may increase the volume of the body 100. In some embodiments, the vertical fold lines 180 may be on one or more sides of the body 100. In the preferred embodiment, the vertical fold lines 180 may form an accordion shape on the one or more sides of the body 100, as seen in FIG. 7B. The vertical fold lines 180 may be made up of one or more individual vertical fold lines. There may be one, two, three, four, five, or six individual vertical fold lines that make up the vertical fold lines 180.

FIGS. 8A to 8C illustrate the preferred embodiment of folding the disposable bag 10. The body 100 of the disposable bag 10 may be decompressed or flatten when the cavity 106 is empty. FIG. 8A shows the the body 100 of the disposable bag 10 with the lower surface 104 facing up in this embodiment. The air release flap 130, shown by dashed lines, is on the upper surface 102 within the middle portion of the body 100. In the preferred embodiment, the user may fold the sealed end portion 120 at a first horizontal fold line 170*a*. Once, the sealed end portion 120 is pressed against the body 100, the first horizontal fold line 170*a* becomes a new edge and may be folded at a second horizontal fold line 170*b*. FIG. 8B shows the embodiment of the disposable bag 10 with the seal end portion 120 folded. The second horizontal 170*b*, the new edge, may be folded at a third horizontal fold line 170*c*. The edge of the open end portion 110 may be folded at the fourth horizontal fold line 170*d*, where the lower surface 104 of body segment portion 108*e* closest to the open end portion 110 rest on top of the upper surface of the body segment portion 108*c* that may contain the air release flap 130. In some embodiments, the edge 190 of the open end portion 110 or body segment portion 108*e* may be tucked under the air release flap 130 to hold the folded disposable bag in place, as best seen in FIG. 8C.

In other embodiments, the air release flap 130 may be tucked into the second opening 160, as seen best in FIG. 8C. In some embodiments, the first seal 148 or the second seal 168 may seal with the third seal 138 located in the air release flap 130 to ensure that the bag does not become unfolded without the user's interaction.

Another example illustrating the disposable bag 10 storing food waste is described below. The user may be at a social event, such as a baseball game, where trash receptacles are not readily available. The user may receive the disposable bag 10 from the stadium with the logo of the home team and may carry the disposable bag 10 that is folded, which may be conveniently carried in the user's pocket. The user may decide to eat a food item that have a food waste byproduct, such as sunflower seeds. The user may unfold the disposable bag 10 by untucking the edge 190 of the open end portion 110 from the air release flap 130 or may unseal the first seal 148 or the second seal 168 from the third seal 138. After the disposable bag 10 is unfolded, the user then may open the first seal 148 on the first opening 140 located at the edge 190 of the open end portion 110. The user may inflate the body 100 of the disposable bag by blowing air into the first opening 148. Once the body 100 of the disposable bag 10 is inflated, the user then tears the edge 190 of the end portion 110 from the body 100 along the tear line 150 to reveal the second opening 160. The user may discard the torn edge 190 of the open end portion 110 into the cavity 106 of the body 100. Now the user may place discarded seed shells directly into the disposable bag 10. The cavity 106 of the disposable bag 10 may be coated with a water impenetrable and fragrance material to prevent leakage from and cover the smell of the discarded sunflower seed shells. Due to the small size of the disposable bag 10, the user may maneuver the disposable bag 10 into a position in front of the user's mouth by holding the bag with the user's hand. This allows the user to avoid sunflower seed shells from being discarded on the ground.

Continuing with the above example, after the user is finished with the food product, the user then may seal the second seal 168 in the second opening 160. The user may then unseal the air release flap 130 via the third seal 138 and release the air from the cavity 106 by pressing the button 134 located next to the air release flap 130. The button 134 causes the one-way valve 132 to release air from the cavity 106 while the user squeezes the body 100 with the user's remaining fingers. The air from the one-way valve 132, which may move through a filter to prevent moisture from exiting the disposable bag 10, may be pushed into the fragrance compartment 139. The air in the fragrance compartment 139 may cause the fragrance material to be expelled along with the air from the disposable bag 10. After deflation of the body 100, the disposable bag 10 may be folded or crumpled to minimize volume. The user may then discard the disposable bag 10 at a later time in a convenient trash receptacle.

This invention reduces the need for cleaning and/or reduces the time needed to clean an area that would traditionally contain waste or food waste. This invention also reduces the need for the user to litter or discard waste due to the lack of convenient trash receptacles.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A disposable bag comprising:

a body having an open end portion and a sealed end portion, wherein the body has an internal cavity that is coated with a scented material, an air release flap located on the body between the open end portion and the sealed end portion, wherein the air release flap allows air to exit the body of the disposable bag, a first opening located at the end of the open end portion, wherein a user blows air into the first opening, a tear line located on the body approximate to the open end portion, wherein the tear line is configured to expose a second opening, wherein the first opening is smaller than the second opening, wherein the body has horizontal fold lines, wherein the body is folded along the horizontal fold lines so that the open end portion is secured against the body by the air release flap.

2. The disposable bag of claim 1, wherein the horizontal fold lines are machine pressed into the body at equal intervals.

3. The disposable bag of claim 1, wherein the body is made of a flexible material, wherein in the flexible material includes at least one of paper, plastic, leather, vinyl, organic fabric, polypropylene, metal, composite metal, or in combination thereof.

4. The disposable bag of claim 1, wherein the body has vertical fold lines, wherein the vertical fold lines extend from the open end portion to the sealed end portion on one or more sides of the body, wherein the vertical fold lines form an accordion shape on the one or more side of the body.

5. The disposable bag of claim 1, wherein the internal cavity is coated with a sealing material, the sealing material includes wax, plastic, polypropylene, or other water impermeable material.

6. The disposable bag of claim 1, further comprising: a first seal, wherein the first seal is located in the first opening; a second seal, wherein the second seal is located in the second opening.

7. The disposable bag of claim 6, wherein the first seal is at least one of an adhesive, a snap fit, a button, a resealable membrane, an interlocking groove and ridge resealable fastener, a fold in tab, a folding wire, a hook and loop fastener, or a combination thereof, wherein the second seal is at least one of an adhesive, a snap fit, a button, a resealable membrane, an interlocking groove and ridge resealable fastener, a fold in tab, a folding wire, a hook and loop fastener, or a combination thereof.

8. The disposable bag of claim 1, wherein the air release flap contains a one-way valve; wherein air is expelled out of the body through the one-way valve.

9. The disposable bag of claim 8, wherein the one-way valve is connected to a fragrance compartment; wherein the fragrance compartment is connected to the one-way valve and configured to receive air from the one-way valve; wherein the air from the one-way valve expels fragrance material out of the fragrance compartment into the ambient atmosphere.

10. The disposable bag of claim 1, wherein the air release flap creates a third opening, wherein a third seal is located in the third opening.

11. The disposable bag of claim 10, wherein the third seal is at least one of an adhesive, a snap fit, a button, a resealable membrane, an interlocking groove and ridge resealable fastener, a fold in tab, a folding wire, a hook and loop fastener, or a combination thereof.

12. The disposable bag of claim 1, wherein the air from the user that is blown from the user's mouth into the first opening unfolds the body from an empty state into an inflated state.

13. A resealable disposable bag comprising:

a body having an open end portion and a sealed end portion, wherein the body has an internal cavity that is coated with a scented material, an air release flap located on the body between the open end portion and the sealed end portion, wherein the air release flap allows air to exit the body of the disposable bag, a first opening located at the end of the open end portion, wherein a user blows air into the first opening, a tear line located on the body approximate to the open end portion, wherein the tear line is configured to expose a second opening, wherein the first opening is smaller than the second opening;

wherein the first opening contains a first seal, wherein the second opening contains a second seal, and wherein an opening within the air release flap contains a third seal, wherein the body has horizontal fold lines, wherein the body is folded along the horizontal fold lines so that the open end portion is secured against the body by the air release flap.

14. The disposable bag of claim 13, wherein the first seal or the second seal mates with the third seal.

15. The disposable bag of claim 13, wherein the first seal, the second seal, and the third seal are at least one of an adhesive, a snap fit, a button, a resealable membrane, an interlocking groove and ridge resealable fastener, a fold in tab, a folding wire, a hook and loop fastener, or a combination thereof.

16. The disposable bag of claim 13, wherein the body is made of a flexible material, wherein in the flexible material includes at least one of paper, plastic, leather, vinyl, organic fabric, polypropylene, metal, composite metal, or a combination thereof.

17. A method for folding a disposable bag, the method comprising:

flattening a body with a seal end portion, an open end portion and a tear line, wherein the open end portion contains a first opening, wherein the tear line exposes a second opening;

folding the sealed end portion along a first horizontal fold line, a second horizontal fold line, and a third horizontal fold line;

folding the open end portion along a fourth horizontal fold line;

tucking an edge of the open end portion under an air release flap located on the body;

wherein the first opening has a first seal, wherein the second opening has a second seal, and an opening of the air release flap has a third seal.

18. The method for folding a disposable bag of claim 17, further comprising:

mating the first seal or the second seal with the third seal to prevent the disposable bag from unfolding.

19. The method for folding a disposable bag of claim 17, wherein the air release flap secures the edge of the open end portion to prevent the disposable bag from unfolding.

20. The disposable bag of claim 13, wherein the air from the user that is blown from the user's mouth into the first opening unfolds the body from an empty state into an inflated state.

* * * * *